US005240900A

United States Patent [19]

Burberry

[11] Patent Number: 5,240,900

[45] Date of Patent: Aug. 31, 1993

[54] MULTICOLOR, MULTILAYER DYE-DONER ELEMENT FOR LASER-INDUCED THERMAL DYE TRANSFER

[75] Inventor: Mitchell S. Burberry, Webster, N.Y.

[73] Assignee: Eastman Kodak Company, Rochester, N.Y.

[21] Appl. No.: 992,351

[22] Filed: Dec. 17, 1992

[51] Int. Cl.[5] ..... B41M 5/035; B41M 5/26

[52] U.S. Cl. ..... 503/227; 428/195; 428/212; 428/327; 428/478.2; 428/508; 428/509; 428/510; 428/913; 428/914; 430/200; 430/201; 430/945

[58] Field of Search ..... 8/471; 428/195, 212, 428/323, 327, 478.2, 508–510, 913, 914; 430/200, 201, 945; 503/227

[56] References Cited

U.S. PATENT DOCUMENTS 4,833,060 5/1989 Nair et al. ..... 430/137

FOREIGN PATENT DOCUMENTS

88/07450 10/1988 World Int. Prop. O. ..... 430/138

*Primary Examiner*—B. Hamilton Hess
*Attorney, Agent, or Firm*—Harold E. Cole

[57] ABSTRACT

This invention relates to a multicolor, multilayer dye donor element for laser-induced thermal dye transfer comprising a support having thereon a first dye layer comprising a homogeneously-dispersed mixture of an image dye having a certain color, a binder and a laser light-absorbing material, the first dye layer being overcoated with at least one additional dye layer comprising solid, homogeneous beads which contain an image dye having a different color than that of the first dye layer, a binder and a laser light-absorbing material, the beads being dispersed in a vehicle, and the beads of each additional dye layer being sensitized to a different wavelength.

18 Claims, No Drawings

MULTICOLOR, MULTILAYER DYE-DONER ELEMENT FOR LASER-INDUCED THERMAL DYE TRANSFER

This invention relates to the use of multicolor dye-containing beads in certain multilayers of a donor element for a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared-absorbing material, such as an infrared-absorbing dye, and one or more image dyes in a binder.

PCT publication WO 88/07450 discloses an inking ribbon for laser thermal dye transfer comprising a support coated with microcapsules containing printing inks and laser light-absorbers. The microcapsules can contain yellow, magenta and cyan dye, each of which is associated with an infrared-absorbing dye at a different wavelength. The microcapsules are randomly mixed together forming a single coated layer on the dye-donor support. These microcapsules can be individually addressed by three lasers, each having a wavelength tuned to the peak of the infrared-absorbing dye and each corresponding to a given color record.

However, there are a number of problems associated with the use of microcapsules in dye-donors. Microcapsules have cell walls that encapsulate ink and associated volatile ink solvents which are typically low-boiling oils or hydrocarbons that can be partially vaporized during printing and evaporate readily on the receiver as the ink dries. The use of volatile solvents can cause health and environmental concerns. In addition, solvent in the microcapsules can dry out over time before printing and therefore lead to changes in sensitivity (i.e., poor dye-donor shelf life). Further, since microcapsules are pressure-sensitive, if they are crushed, ink and solvent can leak out. Still further, microcapsule cell walls burst when printed, releasing ink in an all-or-nothing manner, making them poorly suited for continuous tone applications.

In U.S. Pat. No. 4,833,060, a method is disclosed for making polymeric particles by mixing an oil phase which contains organic components, under high shear conditions, in water with stabilizer and promoter to form an emulsion having a well-defined droplet size distribution. The solvent in the oil phase is then distilled off leaving the solid particles dispersed in water. There is no disclosure in this patent, however, of using this technique to make a dye-donor element for a laser-induced thermal dye transfer system.

It is an object of this invention to provide a multicolor dye-donor element for a laser-induced thermal dye transfer system which avoids the problems noted above with using microcapsules. It is another object of this invention to provide a multicolor dye-donor element whereby a multicolor transfer print can be obtained with only one pass through a laser print engine containing three lasers. It is still another object of this invention to provide a multicolor, multilayer dye-donor element wherein greater color purity and uniformity can be achieved.

These and other objects are achieved in accordance with this invention which relates to a multicolor, multilayer dye donor element for laser-induced thermal dye transfer comprising a support having thereon a first dye layer comprising a homogeneously-dispersed mixture of an image dye having a certain color, a binder and a laser light-absorbing material, the first dye layer being overcoated with at least one additional dye layer comprising solid, homogeneous beads which contain an image dye having a different color than that of the first dye layer, a binder and a laser light-absorbing material, the beads being dispersed in a vehicle, and the beads of each additional dye layer being sensitized to a different wavelength.

The first dye layer comprising a homogeneously-dispersed mixture of an image dye, a binder and a laser light-absorbing material, can comprise any of the materials as discussed below. The materials are mixed together to form a uniform coating.

The beads which contain the image dye, binder and laser light-absorbing material can be made by the process disclosed in U.S. Pat. No. 4,833,060 discussed above, the disclosure of which is hereby incorporated by reference. The beads are described as being obtained by a technique called "evaporated limited coalescence."

The binders which may be employed in the first dye layer and also in the layers containing solid, homogeneous beads of the invention which are mixed with the image dye and laser light-absorbing material include materials such as cellulose acetate propionate, cellulose acetate butyrate, poly(vinyl butyral), nitrocellulose, poly(styrene-co-butyl acrylate), polycarbonates such as Bisphenol A polycarbonate, poly(styrene-co-vinylphenol) and polyesters. In a preferred embodiment of the invention, the binder in the layer is cellulose acetate propionate or nitrocellulose. While any amount of binder may be employed in the layer which is effective for the intended purpose, good results have been obtained using amounts of up to about 50% by weight based on the total weight of the bead, or about 0.1 to about 5 g/m$^2$ in the first dye layer.

The vehicle in which the beads are dispersed to form the additional dye layers of the invention includes water-compatible materials such as poly(vinyl alcohol), pullulan, polyvinylpyrrolidone, gelatin, xanthan gum, latex polymers and acrylic polymers. In a preferred embodiment of the invention, the vehicle used to disperse the beads is gelatin.

The beads are approximately 0.1 to about 20 μm in size, preferably about 1 μm. The beads can be employed at any concentration effective for the intended purpose. In general, the beads can be employed in a concentration of about 40 to about 90% by weight, based on the total coating weight of the bead-vehicle mixture.

Use of the invention improves the optical filtering ability of the bottom (first) layer in a multilayer element without hindering the desired dye transfer from the upper bead layers. The homogeneously-dispersed mixture of the first dye layer results in better color purity and uniformity in the dye transfer image even when the IR dyes in the upper layers have a significant absorption at the wavelength used to address this first layer.

Use of the invention also provides a completely dry printing system that utilizes one conventional dye layer and other layers containing small, solid beads to print images having excellent print density at relatively high printing speed and low laser power. This system is also capable of printing different colors from a single pass with superior color purity using two or more lasers having separated wavelength emissions.

Monocolor dye donor elements are described in copending application Ser. No. 07/992,350 filed concurrently herewith and entitled "Dye-Containing Beads For Laser-Induced Thermal Dye Transfer". Since these elements contain beads of only one color, three passes in a print engine are needed with three different dye donors in order to make a multicolor image.

There are numerous advantages in making a multicolor image by printing with only one single pass dye-donor. Replacing two or more donors with only one donor results in less wasted support, fewer manufacturing steps, simpler finishing, simpler media handling in the printer, simpler quality assurance procedures and faster printing.

Multicolor elements are described in copending application Ser. No. 07/992,236 filed concurrently herewith and entitled "Mixture of Dye-Containing Beads For Laser-Induced Thermal Dye Transfer". These elements contain a mixture of beads having different colors in a single dye layer. While this element can be used to obtain good results in certain systems, it has been found that a multilayered structure of a dye-donor element with beads of different colors in different layers has better color purity due to better thermal isolation of one color from another in the donor and better optical filtering of unwanted absorptions.

Multicolor, multilayer elements are described in copending application Ser. No. 07/992,235 filed concurrently herewith and entitled "Multicolor Dye-Containing Beads For Multilayer Dye-Donor Element for Laser-Induced Thermal Dye Transfer". These elements contain layers of beads having different colors in different dye layers. While this element can be used to obtain good results in certain systems, it has been found that difficulties sometimes arise in making distinct layers without any intermixing of beads between layers. The use of interlayers to prevent intermixing of beads from different layers reduces printing efficiency. By use of this invention, even greater color purity and uniformity can be achieved.

Spacer beads are normally employed in a laser-induced thermal dye transfer system to prevent sticking of the dye-donor to the receiver. By use of this invention however, spacer beads are not needed, which is an added benefit.

To obtain the laser-induced thermal dye transfer image employed in the invention, diode lasers are preferably employed since they offer substantial advantages in terms of small size, low cost, stability, reliability, ruggedness, and ease of modulation. In practice, before any laser can be used to heat a dye-donor element, the element must contain a laser light-absorbing material, such as carbon black or cyanine laser light-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser light-absorbing material can be employed at any concentration effective for the intended purpose. In general, good results have been obtained when the laser light-absorbing material is employed at a concentration of about 6 to about 25% by weight, based on the total weight of the bead, or 0.05 to about 0.5 g/m$^2$ within the dye layer itself or in an adjacent layer. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. As noted above, the laser light-absorbing material is contained in the dye layer or in the layer containing the beads coated on the donor support.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the first layer or additional layers containing beads of the dye-donor employed in the invention provided it is transferable to the dye-receiving layer by the action of the laser. Beads of at least two different colors are employed in the multilayered dye-donor element of the invention in addition to the first dye layer in order to give a multicolor transfer. In a preferred embodiment, cyan, magenta and yellow dyes are used in the layers of the dye-donor element of the invention. Especially good results have been obtained with sublimable dyes such as anthraquinone dyes, e.g., Sumikalon Violet RS® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

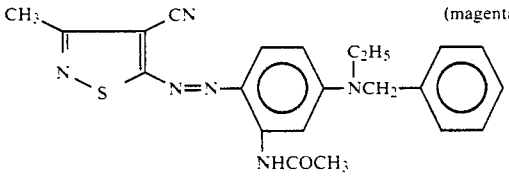
(magenta M-1)

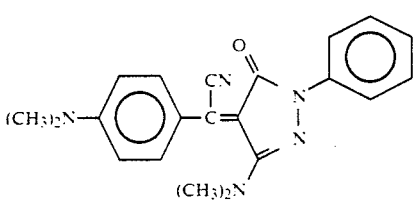
(magenta M-2)

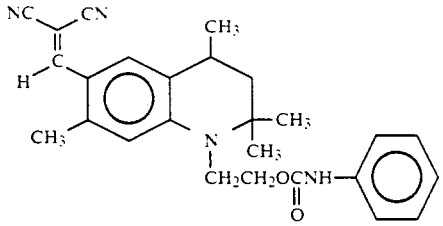
(yellow Y-1)

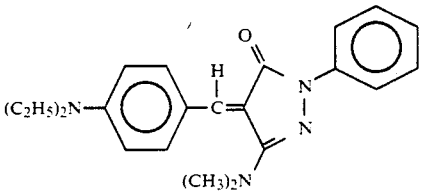
(yellow Y-2)

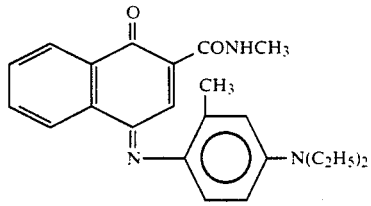
(cyan C-1)

-continued

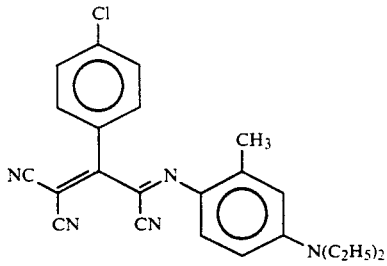
(cyan C-2)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The image dye may be employed in the first dye layer or in the bead layer in any amount effective for the intended purpose. In general, good results have been obtained at a concentration of about 40 to about 90% by weight, based on the total weight of the bead, or about 0.05 to about 1 $g/m^2$ in the first dye layer.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye-receiving element that is used with the dye-donor element employed in the invention usually comprises a support having thereon a dye image-receiving layer or may comprise a support made out of dye image-receiving material itself. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyester, cellulose esters, poly(styrene-co-acrylonitrile), polycaprolactone or mixtures thereof. The dye image-receiving layer may be present in any amount which is effective for the intended purpose. In general, good results have been obtained at a concentration of from about 1 to about 5 $g/m^2$.

A process of forming a multicolor laser-induced thermal dye transfer image according to the invention comprises:

a) contacting at least one multicolor, multilayer dye-donor element as described above, with a dye-receiving element comprising a support having thereon a polymeric dye image-receiving layer;

b) imagewise-heating the dye-donor element by means of a laser; and

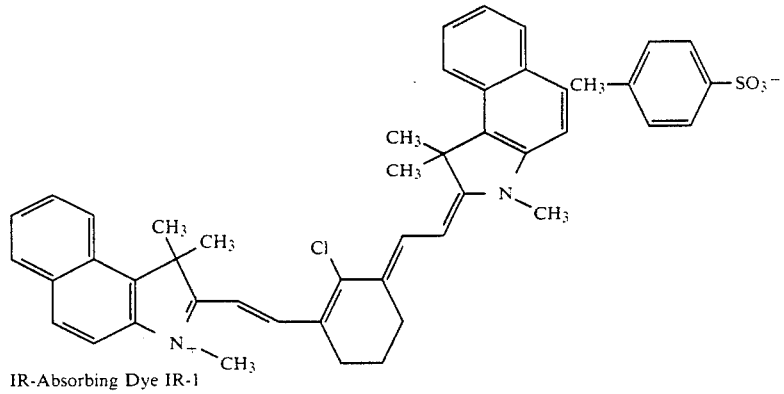

IR-Absorbing Dye IR-1 c) transferring a dye image to the dye-receiving element to form the multicolor laser-induced thermal dye transfer image.

The following examples are provided to illustrate the invention.

PREPARATION OF BEAD DISPERSIONS

A combination of a polymeric binder as described below, image dye, and infrared dye was dissolved in dichloromethane. A mixture of 30 ml of Ludox ® $SiO_2$ (DuPont) and 3.3 ml of AMAE (a copolymer of methylaminoethanol and adipic acid) (Eastman Kodak Co.) was added to 1000 ml of phthalic acid buffer (pH 4). The organic and aqueous phases were mixed together under high shear conditions using a microfluidizer.

The organic solvent was then distilled from the resulting emulsion by bubbling dry $N_2$ through the emulsion. This procedure resulted in an aqueous dispersion of solid beads in a water phase which was coarse-filtered followed by diafiltration, and the particles were isolated by centrifugation. The isolated wet particles were put into distilled water at a concentration of approximately 15 wt. %.

COATING PREPARATIONS

Example 1a and 1b—Solvent-Coated Cyan Layer and Magenta Bead Dispersion Layer A cyan melt was prepared from 0.39 g cyan dye C-1, 1.16 g cyan dye C-2, 0.28 g cellulose acetate propionate (CAP), 0.093 g infrared-absorbing dye S101756 (ICI Corp.), 33.5 g methylene chloride and 14.5 g 1,1,2-trichloroethane. This melt was coated at 1.34 g/m$^2$ (total solids coverage) onto an unsubbed 100 μm poly(ethylene terephthalate) support and allowed to dry.

A 10.14 wt. % aqueous dispersion was prepared from 15.0 g CAP, 15.0 g magenta dye M-1, 15.0 g magenta dye M-2 and 7.0 g infrared-absorbing dye IR-1 illustrated below. A magenta bead coating was made from 6.97 g of the above aqueous dispersion to which had been added 1.11 g of 9% deionized gelatin, 0.87 g of a 10% solution of Dowfax 2A1 ® surfactant (Dow Chemical Company), 1.4 g of a 1% solution of Keltrol ® xanthan gum (Merck & Co.), and 27.05 g deionized water. This magenta bead coating was applied to the coated cyan layer at 0.76 g/m$^2$. This constituted Example 1a—High cyan level. Example 1b—Low cyan level, was prepared similarly except that the coated cyan layer was applied onto the substrate in an amount of only 0.76 g/m$^2$ total solids coverage.

Example 2a and 2b—(Control): Cyan Bead Layer Overcoated with Magenta Bead Layer A cyan bead dispersion was prepared from 1.8 g CAP, 2.5 g cyan dye C-1, 7.5 g cyan dye C-2, and 0.6 g infrared-absorbing dye S101756 (ICI Corp.). This yielded an 18% (solids) bead dispersion. To 7.2 g of this dispersion were added 1.41 g of 9% deionized gelatin, 0.69 g of a 10% solution of Dowfax 2A1 ® surfactant, 3.18 g of a 1% solution of Keltrol ® xanthan gum, and 37.5 g deionized water. The magenta bead dispersion was made the same way as in Example 1.

Again, a high cyan level (Example 2a) and a low cyan level (Example 2b) sample were prepared by coating approximately 1.56 g/m$^2$ (total solids coverage) of the cyan bead dispersion onto an unsubbed 100 μm poly(ethylene terephthalate) support for Example 2A, and approximately 0.99 g/m$^2$ (total solids coverage) onto the same type of support for Example 2b. The cyan bead layers were then overcoated with the magenta bead dispersion at 0.76 g/m$^2$.

Example 3: Cyan Solvent Coating

The cyan melt of Example 1 was coated alone at 1.34 g/m$^2$ (total solids coverage) onto the unsubbed 100 μm poly(ethylene terephthalate) support and allowed to dry.

Example 4: Cyan Bead Dispersion Coating

A control cyan coating was made by coating the cyan bead dispersion of Example 2 alone at 1.56 g/m$^2$ (total solids coverage) onto an unsubbed 100 μm poly(ethylene terephthalate) support and allowed to dry.

Example 5: Magenta Bead Dispersion Coating

A control magenta coating was made by coating the magenta bead dispersion of Example 1 alone at 0.76 g/m$^2$ onto the unsubbed 100 μm poly(ethylene terephthalate) support and allowed to dry.

Three-Laser Print Engine

In experiments where different IR laser wavelengths were required, the assemblage of dye-donor and dye-receiver was printed with a three-laser lathe type printer. The drum, 41 cm in circumference, was typically rotated at 150 rev/min, corresponding to scan speeds of 103 cm/sec. Maximum power available at the dye donor was 44 mW at 784 nm (from a Hitachi model HL-7851G diode laser), 25 mW at 873 nm (from a Sanyo model SDL-6033-101 diode laser) and 34 mW at 980 nm (from a Sarnoff model CD-299R diode laser). The focussed elliptical laser spot sizes, as measured at the $1/e^2$ along the primary axes, were approximately 11.2×9.5 μm at 784 nm, 10.3×8.6 μm at 873 nm, and 17.9×18.1 μm at 980 nm. The lasers can be controlled such that only one laser is on at a time or any combination of lasers is on simultaneously. The drum was translated in the page scan direction with a 10 μm center-to center line pitch corresponding to 1000 lines/cm or 2540 lines/in. A 16 step image was printed by varying the laser from maximum to minimum intensity in 16 equally spaced power intervals. Prints made to a resin coated-paper receiver were fused in acetone vapor at room temperature for 6 minutes.

Sensitometry

Sensitometric data from printed step targets were obtained using a calibrated X-Rite 310 Photographic Densitometer (X-Rite Co., Grandville, Mich.) configured to read Status A red, green, and blue reflection densities.

Results

In these experiments, the cyan layer is sensitized to print using 784 nm light and the magenta layer is sensitized to print with 873 nm light. Unwanted absorption of the IR dye in the magenta bead layer at 784 nm results in magenta contamination of the cyan record, particularly under high exposure conditions. Impurity is measured as the ratio of unwanted green density to wanted red density, or unwanted red density to wanted green density. The results of printing using 784 nm and 873 nm are summarized in the Table.

TABLE

| | Status A Reflection Densities and Ratio of Unwanted/Wanted Density Measured at $D_{max}$ | | | | | |
|---|---|---|---|---|---|---|
| | 784 nm | | | 873 nm | | |
| Example | Wanted Red | Unwanted green | Impurity U/W | Unwanted red | Wanted green | Impurity U/W |
| 1a High Cyan* (solv.) | 0.35 | 0.17 | 0.49 | 0.13 | 0.68 | 0.19 |
| 1b Low Cyan* (solv.) | 0.60 | 0.78 | 1.30 | 0.15 | 0.73 | 0.21 |
| Controls | | | | | | |
| 2a high cyan* beads (aq.) | 0.20 | 0.11 | 0.55 | 0.02 | 0.09 | 0.22 |
| 2b low cyan beads* (aq.) | 0.48 | 1.34 | 2.79 | 0.06 | 0.61 | 0.10 |
| 3 cyan (solv.) | 1.44 | 0.31 | 0.22 | — | — | — |
| 4 cyan beads (aq.) | 0.67 | 0.13 | 0.19 | — | — | — |
| 5 magenta beads (aq.) | — | — | — | 0.05 | 0.84 | 0.06 |

*Contained a magenta bead overcoat

Several conclusions are apparent from the results in the Table. The intrinsic color impurity of the cyan dye set, is about 0.21 (the average of Examples 3 and 4) whereas the magenta dye set (Example 5) gives about 0.06 for the unwanted-red to wanted-green density. Since there is little unwanted absorption of the IR in the cyan layer at 873 nm, the color impurity of magenta transfers is not as sensitive to the thickness, or type of the underlying cyan layer, as is the cyan transfer.

Thicker cyan layers are somewhat less efficient than thinner layers but are more effective at limiting unwanted magenta transfer. In these examples the impurity factor is about 2 to 3 times the intrinsic value for thick coatings (Examples 1a and 2a) while it is about 5 to 10 times higher with thin cyan layers (Examples 1b and 2b).

Furthermore, the solvent-coated cyan layers gave better uniformity of the printed patches, correspondingly higher density, and were better at preventing magenta crosstalk than the bead layers. For example, the high cyan (solvent) coating gave 0.35 red density with a 0.49 impurity factor while the high cyan (solvent) coating of beads gave only 0.20 red density with a 0.55 impurity factor.

In addition to the cyan-plus-magenta examples noted above, a two-color donor was prepared consisting of a solvent-coated black dye layer (containing a mixture of cyan, magenta and yellow dyes) overcoated with a yellow bead layer, following a procedure similar to that described in Example 1a. A four-color continuous tone image was printed using two-color donors by first printing the cyan record with 784 nm while simultaneously printing the magenta record with 873 nm using a donor like the one in Example 1a, and then replacing the donor with the black and yellow combination and printing the black record with 784 nm and yellow with the 873 nm laser. Excellent full color images were obtained in this way.

In another example, a three-color three-layer donor was prepared consisting of a continuous solvent-coated cyan layer, overcoated with a magenta bead layer similar to Example 1a, and overcoated again with a yellow bead layer. The yellow beads were sensitized with an IR absorbing dye Cyasorb-165® (American Cyanamid) that absorbs strongly at 980 nm. An excellent continuous tone image was obtained using three lasers at 784 nm, 873 nm and 980 nm to address the cyan, magenta and yellow records, respectively.

The invention has been described in detail with particular reference to preferred embodiments thereof, but it will be understood that variations and modifications can be effected within the spirit and scope of the invention.

What is claimed is:

1. A multicolor, multilayer dye donor element for laser-induced thermal dye transfer comprising a support having thereon a first dye layer comprising a homogeneously-dispersed mixture of an image dye having a certain color, a binder and a laser light-absorbing material, said first dye layer being overcoated with at least one additional dye layer comprising solid, homogeneous beads which contain an image dye having a different color than that of said first dye layer, a binder and a laser light-absorbing material, said beads being dispersed in a vehicle, and said beads of each said additional dye layer being sensitized to a different wavelength.

2. The element of claim 1 wherein said vehicle is gelatin.

3. The element of claim 1 wherein said binder in said additional layer is cellulose acetate propionate or nitrocellulose.

4. The element of claim 1 wherein said beads are approximately 0.1 to about 20 μm in size.

5. The element of claim 1 wherein said beads are employed at a concentration of about 40 to about 90% by weight, based on the total coating weight of the bead-vehicle mixture.

6. The element of claim 1 wherein each said laser light-absorbing material is a dye.

7. A process of forming a multicolor laser-induced thermal dye transfer image comprising:

a) contacting a multicolor, multilayer dye donor element comprising a support having thereon a first dye layer comprising a homogeneously-dispersed mixture of an image dye having a certain color, a binder and a laser light-absorbing material, said first dye layer being overcoated with at least one additional dye layer comprising solid, homogeneous beads which contain an image dye having a different color than that of said first dye layer, a binder and a laser light-absorbing material, said beads being dispersed in a vehicle, and said beads of each said additional dye layer being sensitized to a different wavelength, with a dye-receiving element comprising a support having thereon a polymeric dye image-receiving layer;

b) imagewise-heating said dye-donor element by means of a laser; and c) transferring a dye image to said dye-receiving element to form said multicolor laser-induced thermal dye transfer image.

8. The process of claim 7 wherein said vehicle is gelatin.

9. The process of claim 7 wherein said binder in said additional layer is cellulose acetate propionate or nitrocellulose.

10. The process of claim 7 wherein said beads are approximately 0.1 to about 20 μm in size.

11. The process of claim 7 wherein said beads are employed at a concentration of about 40 to about 90% by weight, based on the total coating weight of the bead-vehicle mixture.

12. The process of claim 7 wherein each said laser light-absorbing material is a dye.

13. A thermal dye transfer assemblage comprising:

(a) a multicolor, multilayer dye donor element for laser-induced thermal dye transfer comprising a support having thereon a first dye layer comprising a homogeneously-dispersed mixture of an image dye having a certain color, a binder and a laser light-absorbing material, said first dye layer being overcoated with at least one additional dye layer comprising solid, homogeneous beads which contain an image dye having a different color than that of said first dye layer, a binder and a laser light-absorbing material, said beads being dispersed in a vehicle, and said beads of each said additional dye layer being sensitized to a different wavelength, and (b) a dye-receiving element comprising a support having thereon a dye image-receiving layer, said dye-receiving element being in superposed relationship with said dye-donor element so that said dye layer is in contact with said dye image-receiving layer.

14. The assemblage of claim 13 wherein said vehicle is gelatin.

15. The assemblage of claim 13 wherein said binder in said additional dye layer is cellulose acetate propionate or nitrocellulose.

16. The assemblage of claim 13 wherein said beads are approximately 0.1 to about 20 μm in size.

17. The assemblage of claim 13 wherein said beads are employed at a concentration of about 40 to about 90% by weight, based on the total coating weight of the bead-vehicle mixture.

18. The assemblage of claim 13 wherein each said laser light-absorbing material is a dye.

* * * * *